US006691935B1

(12) United States Patent
Potz et al.

(10) Patent No.: US 6,691,935 B1
(45) Date of Patent: Feb. 17, 2004

(54) INJECTION NOZZLE

(75) Inventors: Detlev Potz, Stuttgart (DE); Gerhard Mack, Stuttgart (DE); Achim Brenk, Kaempfelbach-Bilfingen (DE); Wolfgang Klenk, Loechgau (DE); Thomas Kuegler, Korntal-Muenchingen (DE); Roland Bleher, Stuttgart (DE); Uwe Gordon, Markgroeningen (DE); Manfred Mack, Altheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/958,375

(22) PCT Filed: Feb. 2, 2001

(86) PCT No.: PCT/DE01/00394

§ 371 (c)(1),
(2), (4) Date: Mar. 4, 2002

(87) PCT Pub. No.: WO01/59293

PCT Pub. Date: Aug. 16, 2001

(30) Foreign Application Priority Data

Feb. 7, 2000 (DE) ..... 100 05 373
Jan. 8, 2001 (DE) ..... 101 00 512

(51) Int. Cl.[7] ..... F02M 61/20

(52) U.S. Cl. ..... 239/533.9; 239/96; 239/124; 239/533.7

(58) Field of Search ..... 239/96, 124, 533.3, 239/533.7, 533.12, 533.9; 123/467

(56) References Cited

U.S. PATENT DOCUMENTS

| | | | | |
|---|---|---|---|---|
| 4,640,252 A | | 2/1987 | Nakamura et al. | |
| 5,048,489 A | * | 9/1991 | Fischer et al. | 123/467 |
| 5,682,858 A | * | 11/1997 | Chen et al. | 123/467 |
| 5,823,161 A | * | 10/1998 | Potz et al. | 239/456 |
| 6,105,879 A | * | 8/2000 | Potz et al. | 239/88 |

FOREIGN PATENT DOCUMENTS

DE 19504849 8/1996

OTHER PUBLICATIONS

Patent Abstracts of Japan, vol. 1999, No. 01, Jan. 29, 1999, & JP 10 281038 A (Denso Corp.) Oct. 20, 1998, Abstract.

* cited by examiner

*Primary Examiner*—Dinh Q. Nguyen
(74) *Attorney, Agent, or Firm*—Ronald E. Greigg

(57) ABSTRACT

In an injection nozzle for a fuel injection system, the opening stroke of the nozzle needle is to be limited selectively, so that different injection cross sections can be employed. To that end, the injection nozzle is provided with a nozzle body, a nozzle needle displaceable in the nozzle body, two groups of injection ports, which are uncovered as a function of an opening stroke of the nozzle needle, a piston that is connected to the nozzle needle, a stop chamber in which the piston is disposed and which is provided with an outlet, and a control valve that can open and close the outlet of the stop chamber, as a result of which the stroke of the piston in the stop chamber and thus the opening stroke of the nozzle needle can be selectively limited.

22 Claims, 11 Drawing Sheets

INJECTION NOZZLE

CROSS-REFERENCE TO RELATED APPLICATIONS

This application is a 35 U.S.C. 371 application of PCT/DE 01/00394, filed on Feb. 2, 2001.

BACKGROUND OF THE INVENTION

1. Field of the Invention

The invention relates to a fuel injection nozzle, which is provided with a nozzle body, a nozzle needle displaceable in the nozzle body, and two groups of injection ports. Depending on the magnitude of the opening stroke of the nozzle needle, either only one group of injection ports or both groups of injection ports are used for the injection. In this way, different injection cross sections can be employed, so that the fuel injection can be adapted better to the existing operating conditions of the internal combustion engine that is supplied by the injection system.

2. Description of the Prior Art

To enable selecting the injection cross section as desired, the opening stroke of the nozzle needle must be controlled as precisely as possible. By now, various attempted solutions to this problem exist. One possibility of controlling the opening stroke is to bring about the opening and closing of the nozzle needle directly by a piezoelectric actuator. In this way, virtually any arbitrary intermediate position within the needle stroke can be approached and maintained. Another possibility for controlling the opening stroke is to control the fuel pressure, which brings about the opening of the nozzle needle, in such a way that the desired opening stroke is established.

An object of the invention is to create a fuel injection nozzle in which the opening stroke of the nozzle needle can be limited to a desired value at little effort or expense and with high reliability. Another object of the invention is to create a fuel injection nozzle in which the injection cross section can be selected independently of all other parameters.

SUMMARY OF THE INVENTION

An injection nozzle according to the invention has the advantage that the opening stroke of the nozzle needle can be limited in the desired way at little effort or expense. If only a slight opening stroke is desired, then the control valve is closed, so that the fluid present in the stop chamber is prevented from flowing out. The control valve that controls the outlet from the stop chamber can be actuated with only little energy, since it is not acted upon directly by the high pressure that causes the opening of the nozzle needle. The control valve can also be actuated during the intervals between injections by the injection nozzle, that is, between two successive injection cycles, so that the switching events take place in phases when only low pressure is imposed, and stringent requirements in terms of timing need not be made of the switching phases. By the switching event, that is, the opening and closure of the control valve between two injections, the length that the opening stroke should have is already defined prior to a nozzle needle stroke. In contrast to this, in the known systems, the opening stroke has to be interrupted at a certain instant, which is why stringent demands are made in terms of the timing precision of the switching event.

BRIEF DESCRIPTION OF THE DRAWINGS

Drawings

The invention is described below in terms of various embodiments which are shown in the accompanying drawings. In these, FIG. 1, in a sectional view, shows an injection nozzle in a first embodiment of the invention.

DESCRIPTION OF THE PREFERRED EMBODIMENTS

Figure 1:
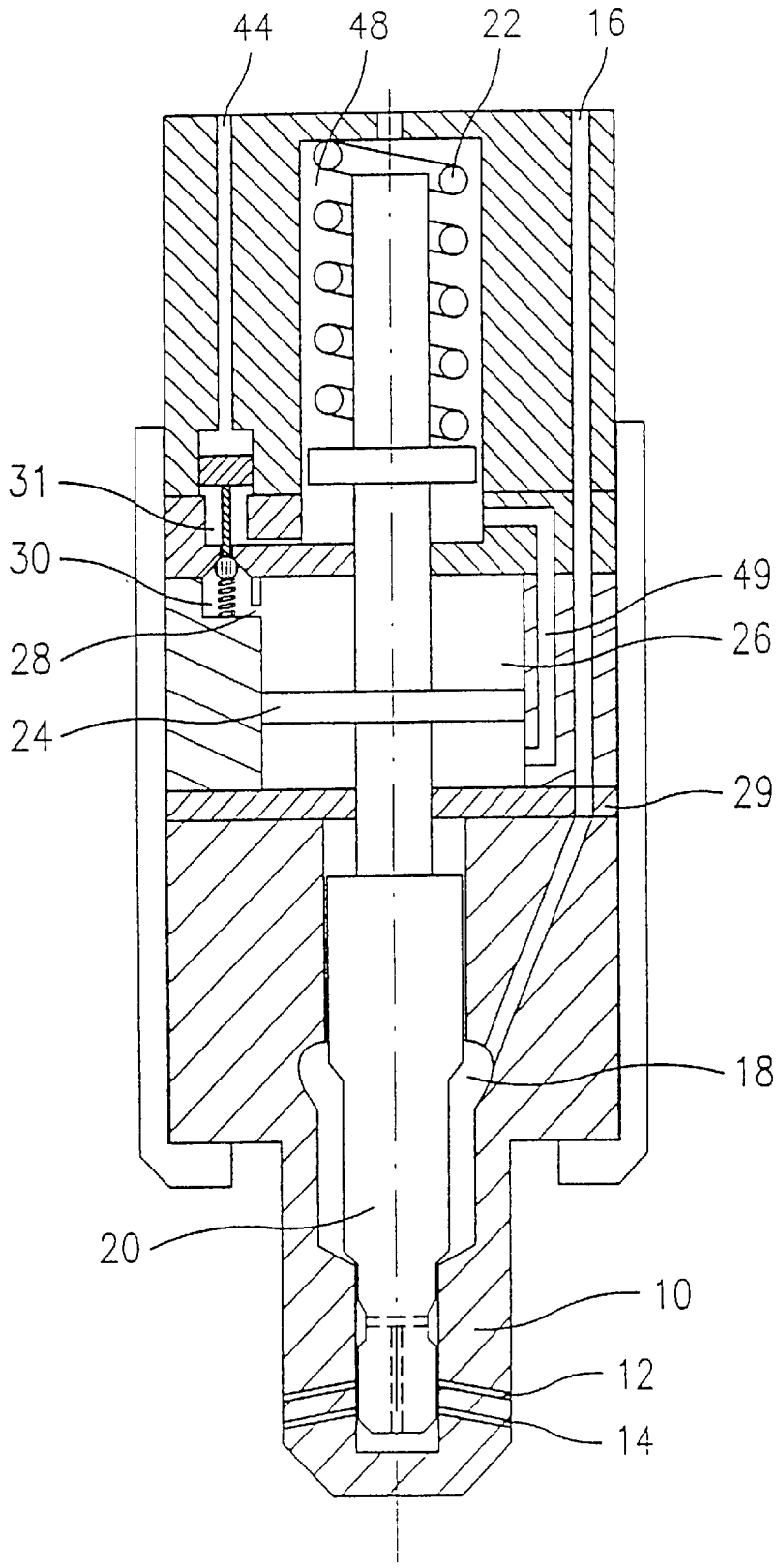

In FIG. 1, an injection nozzle is shown that has a nozzle body 10 provided on its end toward the combustion chamber with two groups of injection ports 12, 14, through which fuel can be injected that is delivered via a supply bore 16 and a pressure chamber 18.

A nozzle needle 20 is disposed displaceably in the nozzle body 10. The nozzle needle is urged by a restoring spring 22 into a position in which the injection ports 12, 14 are closed. By application of a sufficiently high fuel pressure to the pressure chamber 18, the nozzle needle 20 can be displaced upward, in terms of FIG. 1, counter to the action of the compression spring 22, so that as a function of the length of this opening stroke, either only the injection ports 14 or the injection ports 12 as well are uncovered. Since for opening the injection ports the nozzle needle 20 is displaced inward into the interior of the nozzle body 10, this type of injection nozzle is known as an inward-opening injection nozzle.

The nozzle needle 20 is provided with a piston 24, which is disposed displaceably in a stop chamber 26 that is embodied in the nozzle body 10. The term "piston" is understood here to mean any suitable design which upon an opening stroke of the nozzle needle can bring about a volumetric displacement of a fluid, which in turn can be varied for the control purposes described hereinafter.

The piston 24 divides the stop chamber 26 into two portions; the portion of the stop chamber 26 that is remote from the injection ports relative to the piston is provided with an outlet 28. A stop plate 29 is disposed between the piston 24 and the nozzle needle 20 and limits the maximum opening stroke of the nozzle needle.

The outlet 28 leads to a valve chamber 30 (see also FIG. 3) of a control valve 31. Disposed in the valve chamber is a valve ball 32, which is urged by a valve spring 34 against a valve seat 36.

The side of the valve ball 32 remote from the valve spring 34 is engaged by an actuating part, which comprises a control piston 38 and an extension 40. The control piston 38 is disposed in a control chamber 42, whose portion remote from the valve chamber 30 communicates with a control line 44, and whose portion toward the valve chamber 30 communicates with a return line 46. The return line 46 leads into a leakage collection chamber 48 in the nozzle body 10. Also communicating with the leakage collection chamber 48 is a leakage removal line 49, which discharges between the stop plate 29 and the piston 24.

Figure 3:
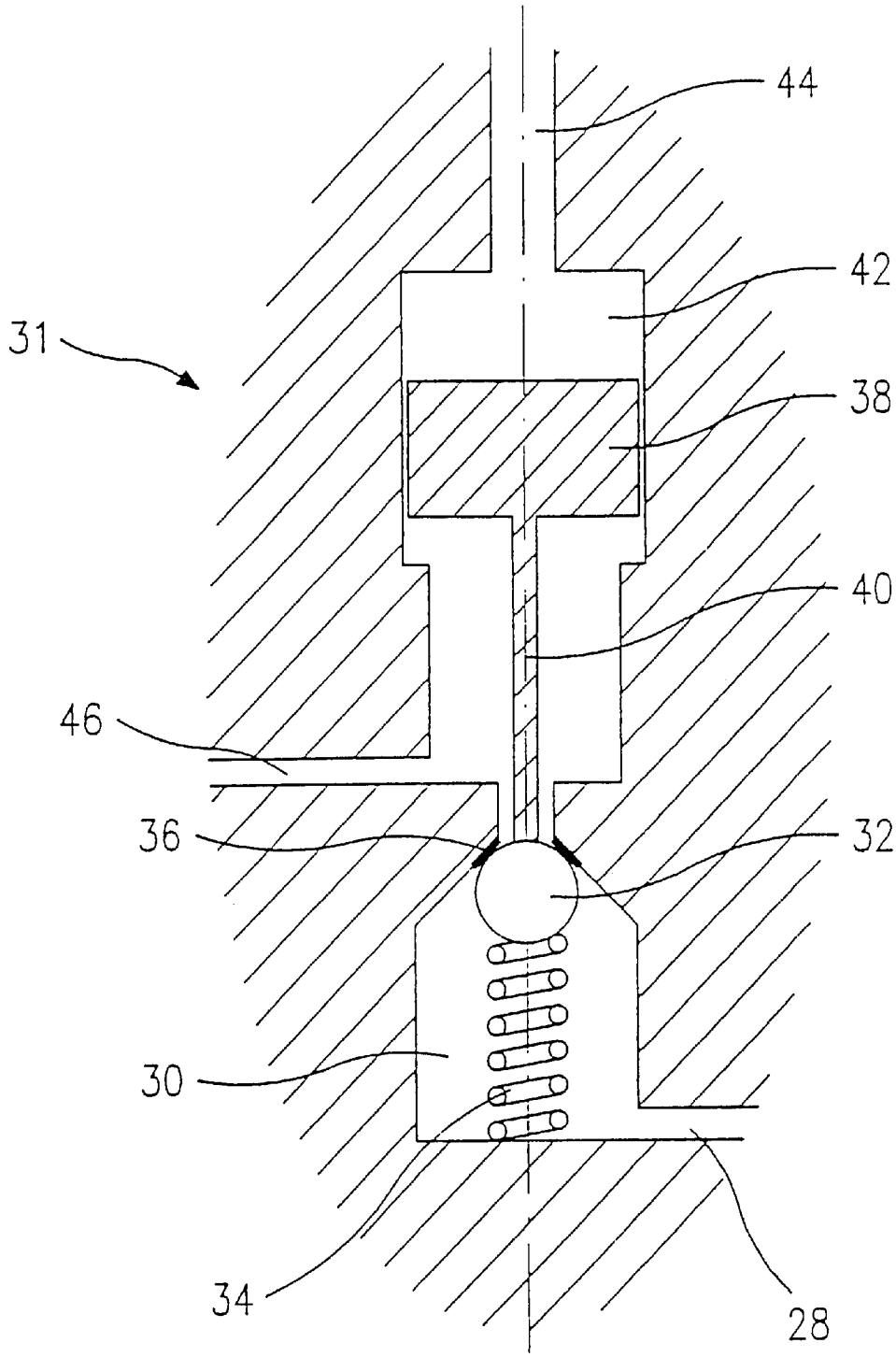
FIG. 3, in an enlarged sectional view, shows the control valve that is used in the injection nozzles shown in FIGS. 1 and 2.
Figure 3A:
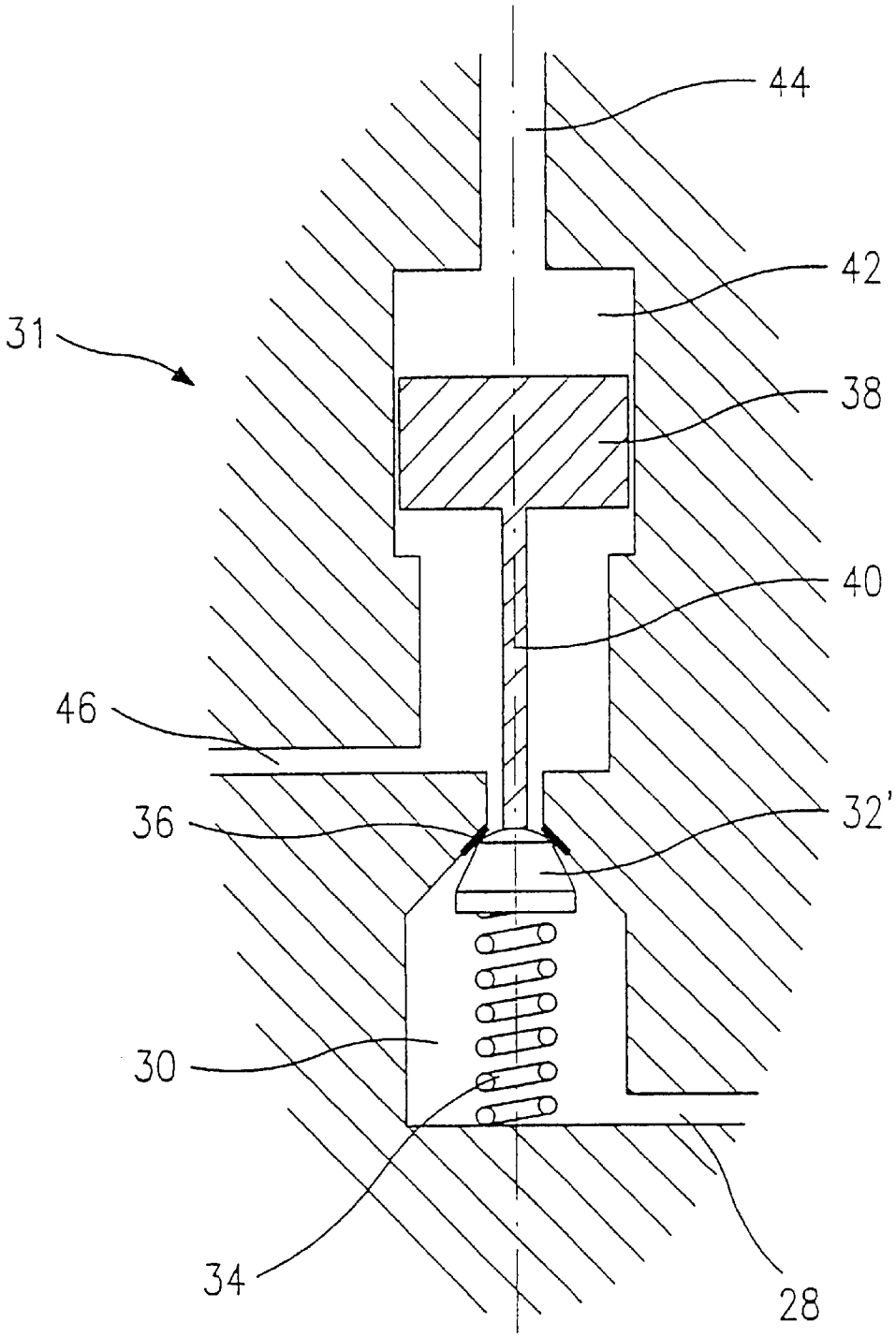
FIG. 3*a*, in an enlarged sectional view, shows a variant embodiment of the control valve shown in FIG. 3.

As can be seen from the variant embodiment of FIG. 3*a*, a valve cone 32' can be used instead of the valve ball 32.

The injection nozzle described functions as follows: Before the onset of injection, it is determined as a function of external parameters whether a complete opening stroke of the nozzle needle is required, in which case both groups of injection ports 12, 14 are opened, or only a partial opening stroke is required, in which case only the injection ports 14 are uncovered. If a complete opening stroke is required, then by application of a suitable pressure to the control line 44, such as a fuel prefeed pressure, the control piston is displaced toward the valve chamber 30, so that the valve ball 32, counter to the action of the valve spring 34, is lifted from the valve seat 36 by means of the extension 40. The outlet 28 from the stop chamber 26 to the return line 46 is thus opened.

If with the control valve 31 open, the nozzle needle 20 is now opened by application of a suitable fuel pressure to the supply bore 16, the fluid present in the stop chamber 26 above the piston 24 can escape from the stop chamber 26, moving past the valve ball 32. Thus the nozzle needle 20 can be opened completely, since the piston 24 is capable of virtually free displacement in the stop chamber 26; the maximum opening stroke is defined by the stop plate 29.

If conversely only a partial opening stroke of the nozzle needle 20 is required, no pressure is applied to the control line 44. This enables the valve spring 34 to press the valve ball 32 against the valve seat 36, so that the connection from the outlet 28 to the return line 46 is blocked.

If a pressure such that the nozzle needle 20 is urged in the opening direction is exerted on the nozzle needle 20 via the supply bore 16, the fluid contained in the stop chamber 26 above the piston 24 and in the valve chamber 30 acts as a hydraulic spring, which enables only a limited opening of the nozzle needle. The rigidity of this hydraulic spring is adapted such that the desired partial opening stroke, at which only the group of injection ports 14 is uncovered, is attained.

Figure 5:
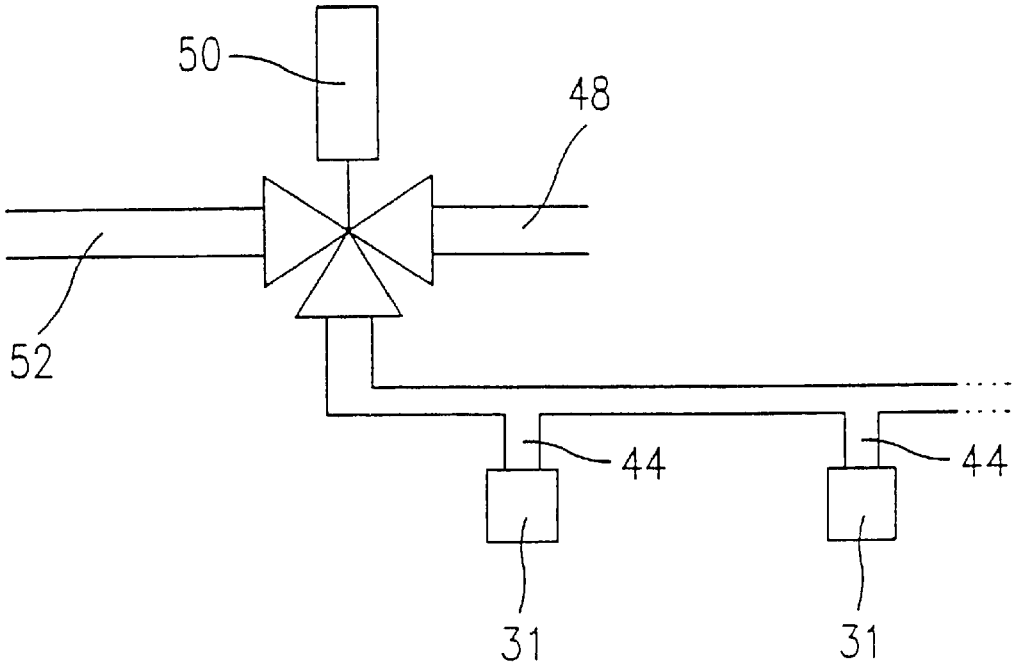
FIG. 5, in a schematic elevation view, shows a hydraulic circuit of the kind that can be used in the control valve of FIG. 3.

FIG. 5 shows how the control valves of all the injection nozzles of an injection system can be switched jointly. The control lines are controlled jointly by an actuator 50, which can cause the control lines to communicate with either a prefeed line 52 or a leakage collection chamber. If the control lines 44 communicate with the prefeed line, the control pistons of the individual control valves are acted upon by fuel that is at prefeed pressure. As a result, the control valve is opened, so that the outlet 28 from the stop chamber 26 communicates with the leakage collection chamber, and complete opening of the nozzle needles of the injection nozzles is possible. Conversely, if the control lines 44 communicate with the leakage collection chamber, then the control valves 31 are closed, so that a limitation of the opening stroke of the nozzle needles is performed.

A special characteristic of this stroke limitation is that the opening and closing of the control valve takes place in the intervals between injections, and thus in the unstressed state of the valve; hence the forces for actuating the control valve are very slight. Because of the immediate vicinity of the control valve to the stop chamber, a small volume results, and hence there is a rigid characteristic curve of the hydraulic spring formed by the enclosed volume. Since the control valve can be actuated with fuel that need not be at injection pressure, but instead is merely at low pressure, for instance prefeed pressure, energy consumption is low and the structure is simple, since no high-pressure lines are required. Furthermore, no problems with pressure fluctuations occur. As an alternative to using the prefeed pressure of the fuel, the low pressure can also be furnished by a separate supply system, or by a leakage flow from the high-pressure system.

Figure 2:
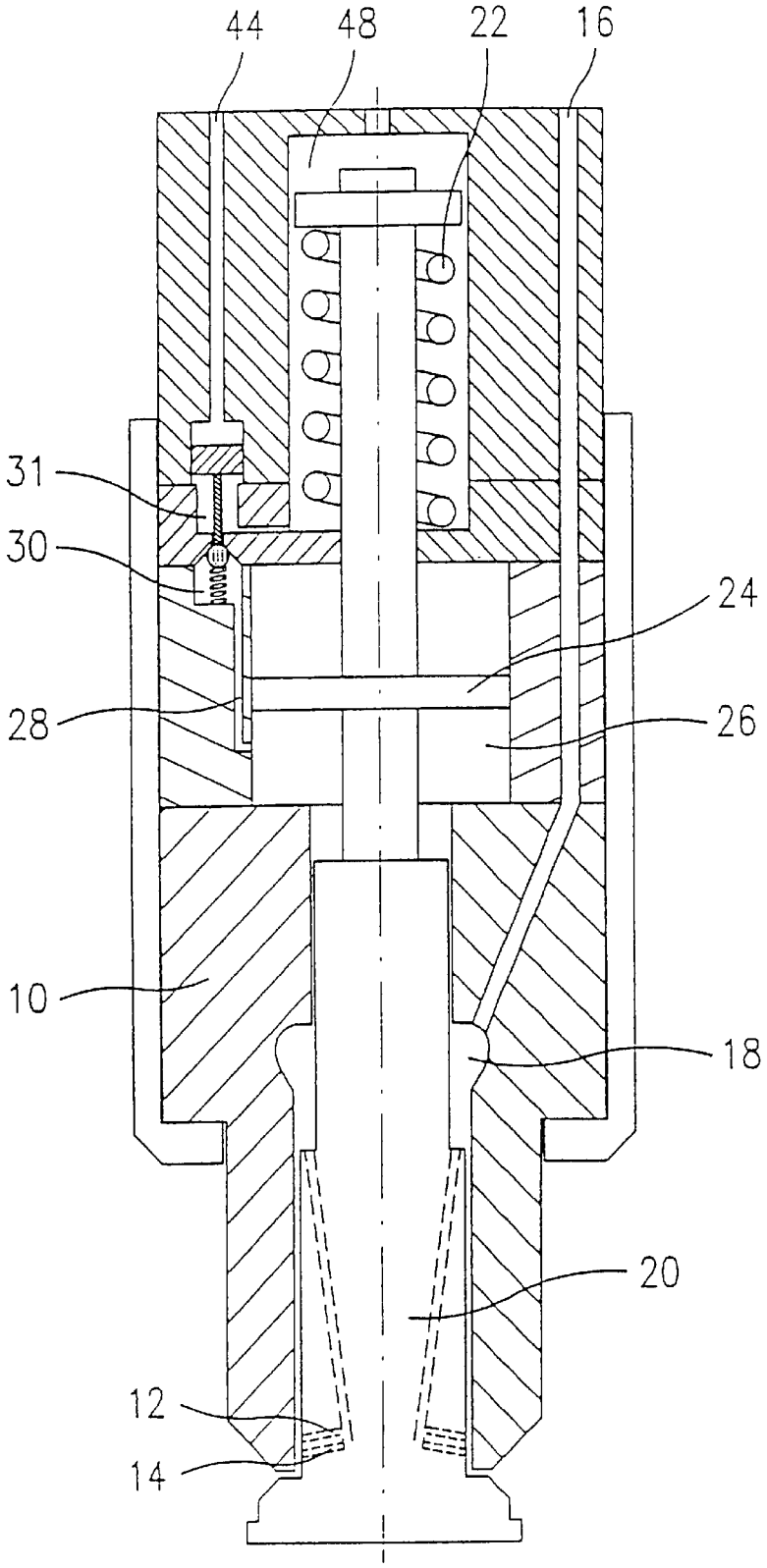
FIG. 2, in a sectional view, shows a second embodiment of the invention.

In FIG. 2, an injection nozzle in accordance with a second embodiment is shown. For components that are known from the first embodiment, the same reference numerals are used, and reference is made to the above descriptions. Unlike the injection nozzle of the first embodiment, the injection nozzle of the second embodiment is an outward-opening injection nozzle, that is, an injection nozzle in which the nozzle needle 20 is displaced outward for opening, toward the combustion chamber. For this reason, the outlet 28 is disposed in the portion of the stop chamber 26 that relative to the piston 24 is oriented toward the injection ports.

In terms of the mode of operation, there are no distinctions from the injection nozzle of the first embodiment.

Figure 4:
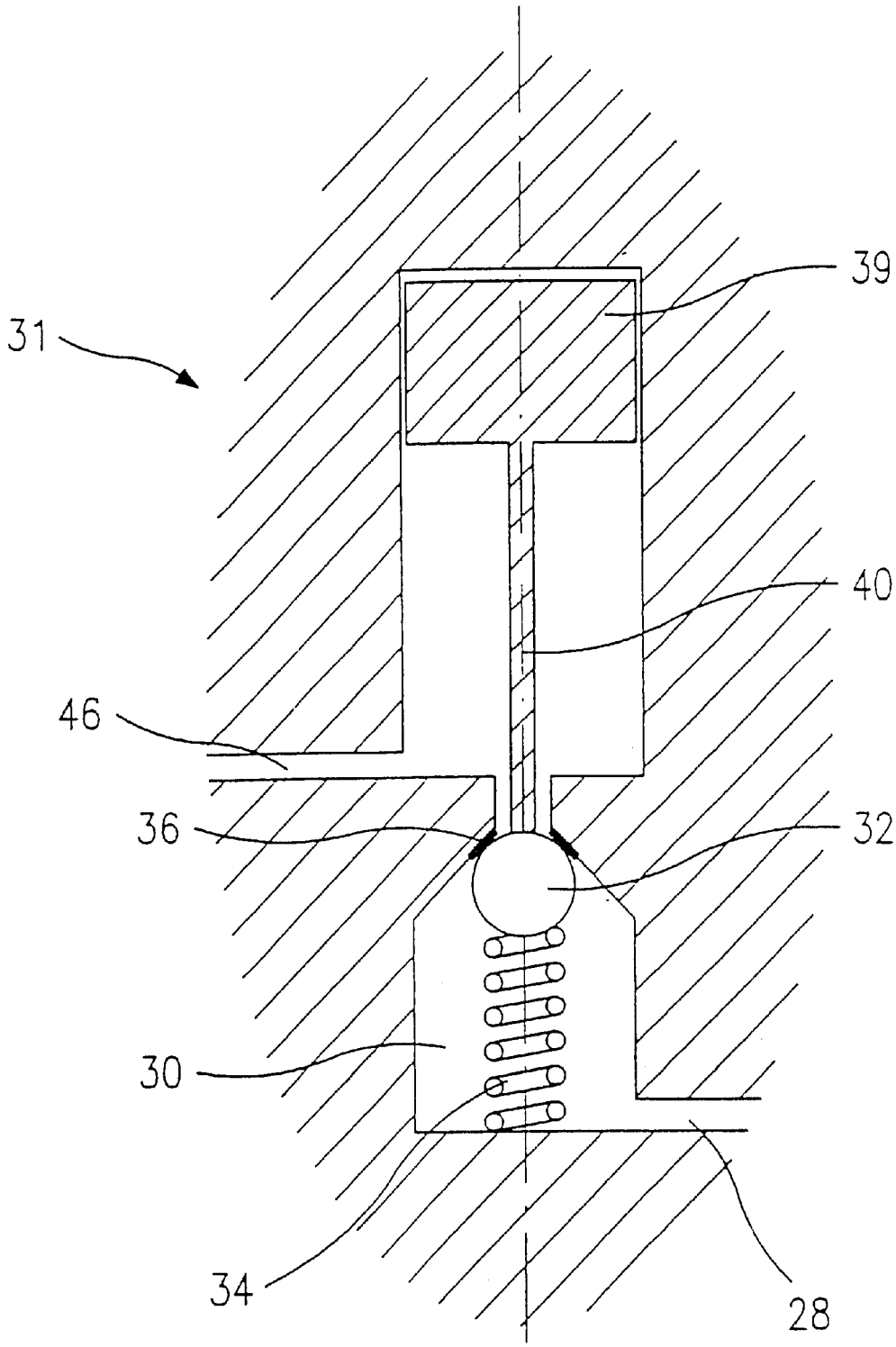
FIG. 4, in an enlarged sectional view, shows an alternative version of the control valve.

In FIG. 4, a variant of the control valve shown in FIG. 3 is shown. Instead of the control piston 38, a piezoelectric actuator 39 is used here, which together with the extension forms the actuating part for the valve ball 32. The piezoelectric actuator 39, by changing its length, can directly move the extension 40 toward the valve spring 34 in such a way that the valve ball 32 is lifted from the valve seat 36; instead of the control line 44, cables (not shown) are used for applying the requisite voltage to the piezoelectric actuator.

Figure 6:
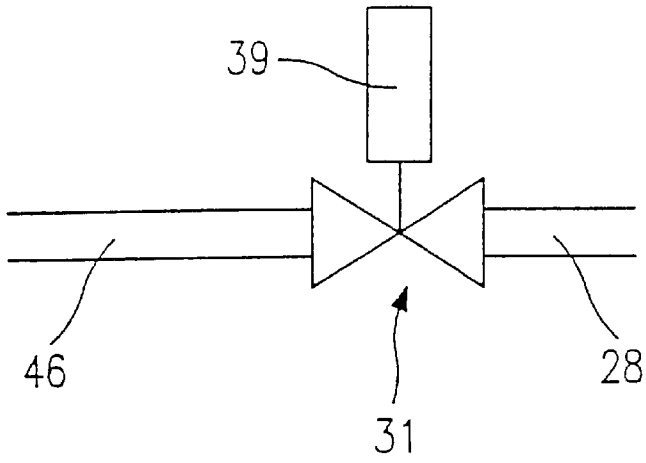
FIG. 6, in a schematic elevation view, shows the hydraulic circuit for the variant of the control valve in FIG. 4.

In FIG. 6, the control valve 31 of the variant of FIG. 4 is shown schematically. The piezoelectric actuator 39, by actuating the valve ball 32, can open or close the communication between the outlet 28 and the return line 46, in order in this way to achieve a variable stroke of the nozzle needle 20 of the injection nozzle.

Figure 7B:
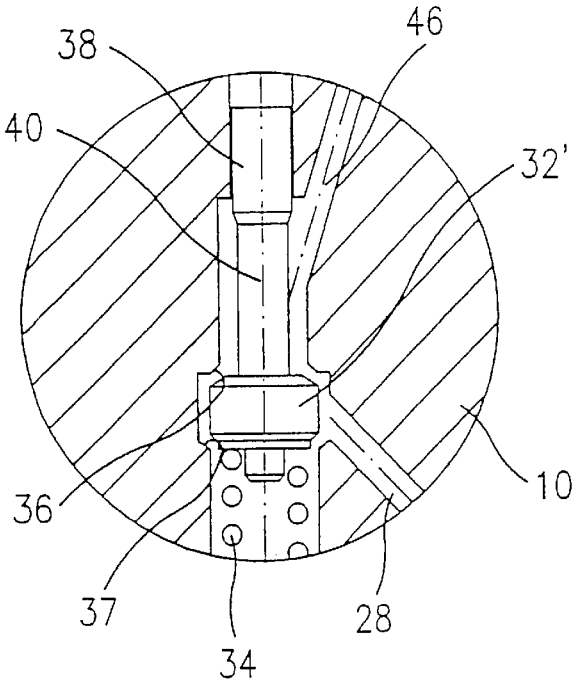
FIG. 7*b* on an enlarged scale, schematically shows the control valve used in the injection nozzle of FIG. 7*a;*
Figure 7A:
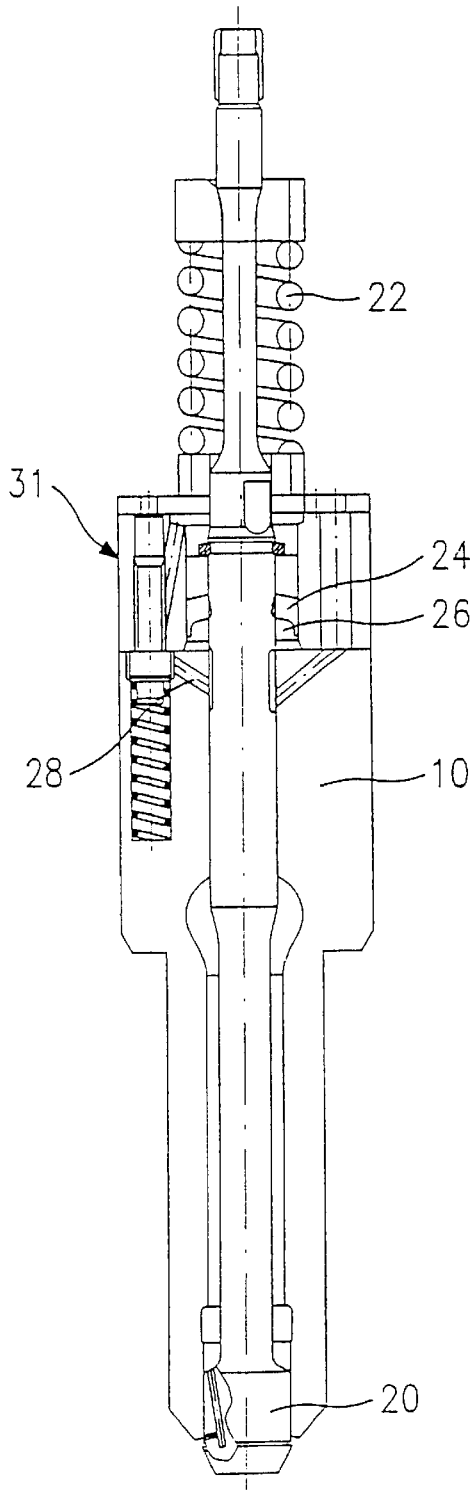
FIG. 7*a* shows an injection nozzle in a first variant of the second embodiment.

In FIGS. 7*a* and *b*, a first variant of the second embodiment is shown, that is, an outward-opening injection nozzle. To the extent that components known from the previous figures are used in this variant, the same reference numerals are used, and reference is made to the above descriptions.

Unlike the control valve that is shown in FIG. 3*a*, in the control valve shown in detail in FIG. 7*b*, in addition to the first valve seat 36 a second valve seat 37 is used, which is located opposite the first valve seat, on the other side of the valve cone 32'.

When the valve cone rests on the first valve seat, the outlet from the stop chamber 26 is closed. In this state, a hydraulic stroke stop is formed, which limits the opening stroke of the nozzle needle 20 after a distance of approximately 50% of the maximum opening stroke, or in other words stops the opening motion of the nozzle needle.

If the control piston 38 is acted upon by low pressure, which is preferably less than 10 bar, the control valve is opened and the valve cone is lifted from the first valve seat and is moved into contact with the second valve seat 37. As a result, the communication between the stop chamber, via its outlet 28, and the return line is opened, so that the quantity of fluid positively displaced by the piston 24 in the opening stroke of the nozzle needle can flow out of the stop chamber 26.

The second valve seat serves, in a possible pressure buildup in the control valve, to prevent a closing force from acting on the valve cone that urges it toward the first valve seat and closing the control valve. Such a pressure buildup could be caused by the flow resistance that is operative upon a fluid pressure flow when the nozzle needle opens. In a pressure buildup, a closing force would be generated that on the one hand is determined by the pressure difference between the pressure acting on the control piston and the pressure on the side of the valve cone remote from the control piston, and on the other by the cross-sectional area of the control piston. When the valve cone now rests on the second valve seat, the area of the valve cone that is definitive for the closing force is decoupled from the pressure in the control valve, so that this area is inoperative in the event of a pressure increase in the control valve. As a result, upon a pressure increase, no closing force is generated but on the contrary an opening force, which reinforces the force furnished by the control piston and which presses the valve cone still more firmly against the second valve seat (self-holding function). Thus there is no need to note whether the low pressure exerted on the control piston is capable of keeping the valve cone in the opened position under all operating conditions, or not.

Using low pressure to trigger the control valve results in markedly reduced diversion quantities and hence improved hydraulic efficiency. The reduced return quantities, which are at a high temperature, also mean a reduction in the temperature stresses on the fuel tank system.

Figure 7C:
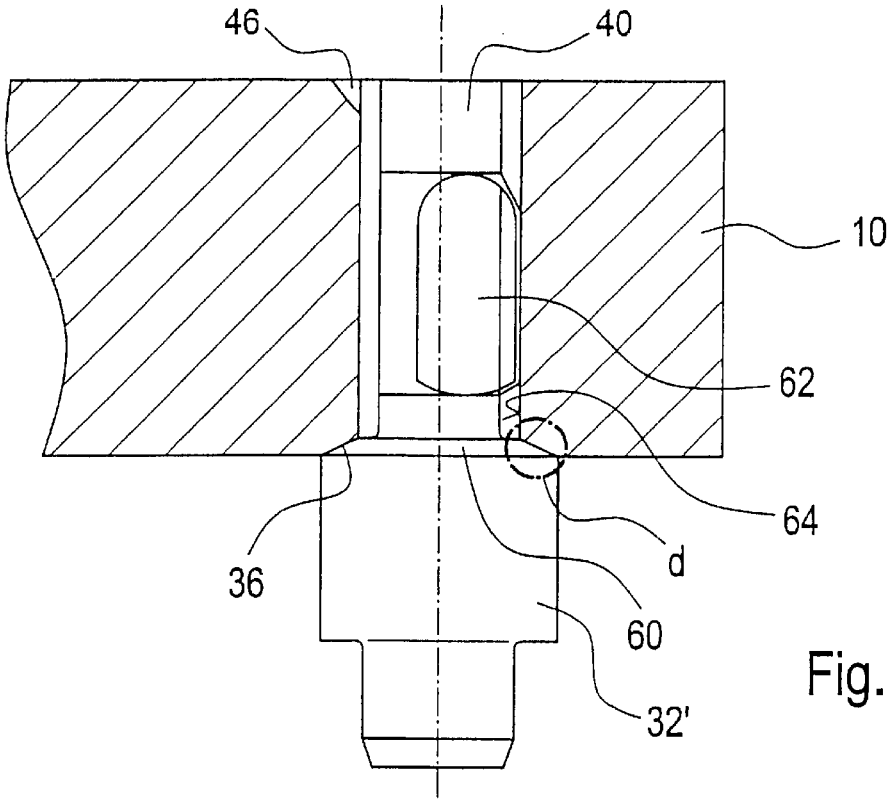
FIG. 7*c*, on an enlarged scale, schematically shows a detail of a variant of the control valve shown in FIG. 7*b;*
Figure 7D:
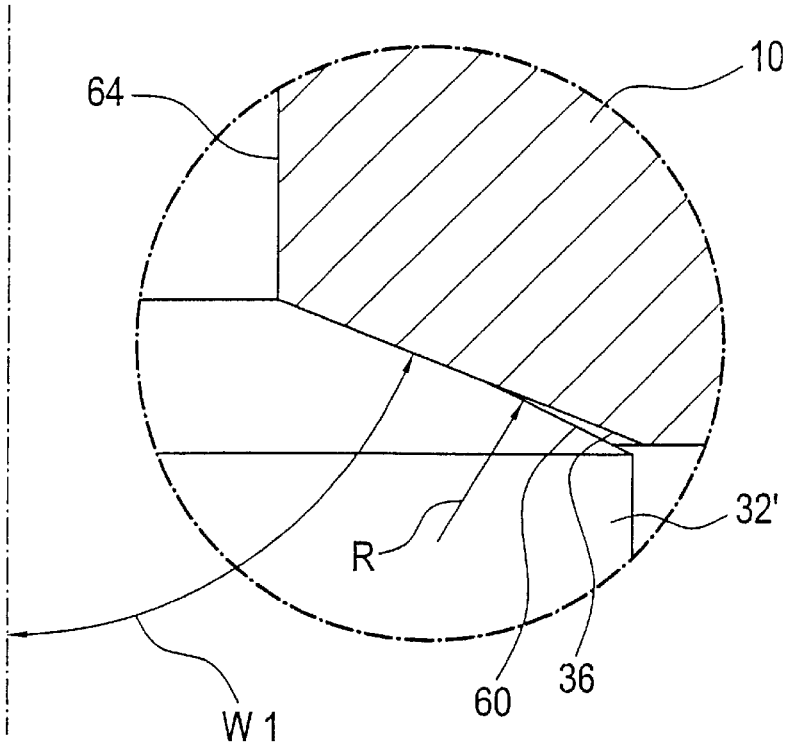
FIG. 7*d* shows the detail d of FIG. 7*c*, enlarged still further.

In FIGS. 7*c* and 7*d*, a variant of the control valve shown in FIG. 7*b* is shown. The valve cone 32' has a valve face 60, oriented toward the valve seat 36, that is embodied as a spherical portion of radius R. The radius R is selected as comparatively large. If the diameter of the valve seat is 2 mm, the radius R is on the order of magnitude of 3 mm. The valve seat is embodied such that the cone formed by it has an opening angle W1 of 70° relative to the center axis of the valve cone.

The extension 40 of the valve cone 32' is provided with a protrusion 62, which is located in the guide bore 64 for the valve cone 32'. In this way, a dual guidance for the valve cone is provided, so that a radial displacement of the valve cone, which could be brought about by a pressure wave arriving from the diversion bore and/or by radial forces of the valve spring 34, is reliably prevented. This guarantees the correct position of the valve cone on the valve seat, which enhances the reliability of the sealing action.

Figure 7E:
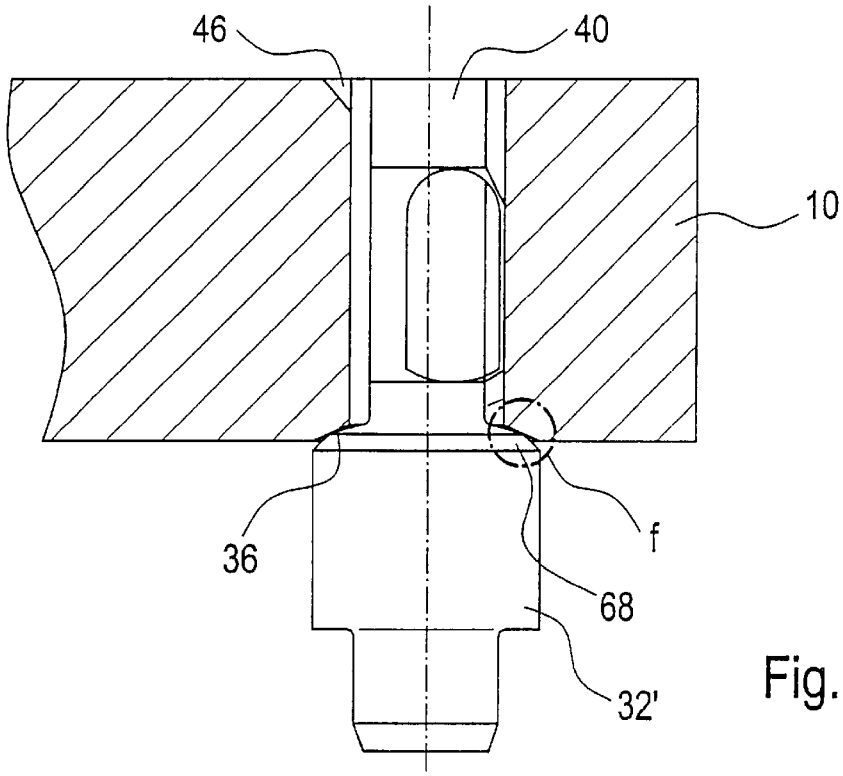
FIG. 7*e*, on an enlarged scale, schematically shows a detail of a further variant of the control valve shown in FIG. 7*b;*
Figure 7F:
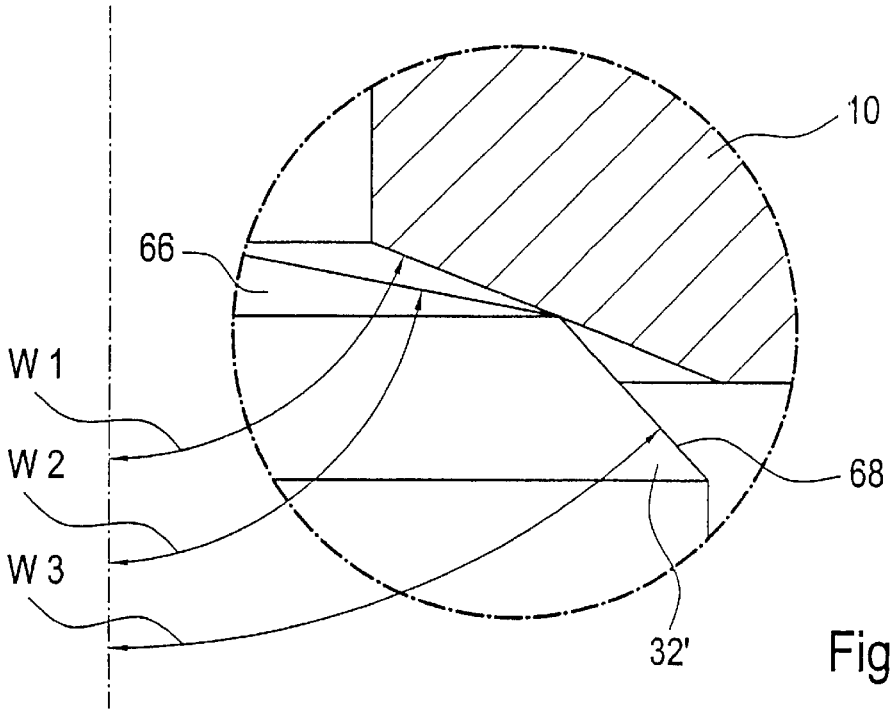
FIG. 7*f* shows the detail marked "f" in FIG. 7*e*, enlarged still further.

In FIGS. 7*e* and 7*f*, a further variant of the control valve shown in FIG. 7*b* is shown. The valve cone 32' has a valve face 60, oriented toward the valve seat 36, that is embodied here by two frustoconical faces 66, 68. The valve seat is embodied such that the cone formed it has an opening angle W1 of 70° relative to the center axis of the valve cone. The two frustoconical faces 66 and 68 form an angle W2 and W3, respectively, with the center axis of the cone that is on the order of magnitude of 80° and 45°, respectively.

The double-cone valve face means purely linear contact and thus high pressure per unit of surface area, which favorably affects the sealing action. Also in comparison to the spherical valve face, the double-cone valve face can be produced better and more replicably, which in turn enhances the reliability of the sealing action and moreover leads to a cost reduction.

Figure 7G:
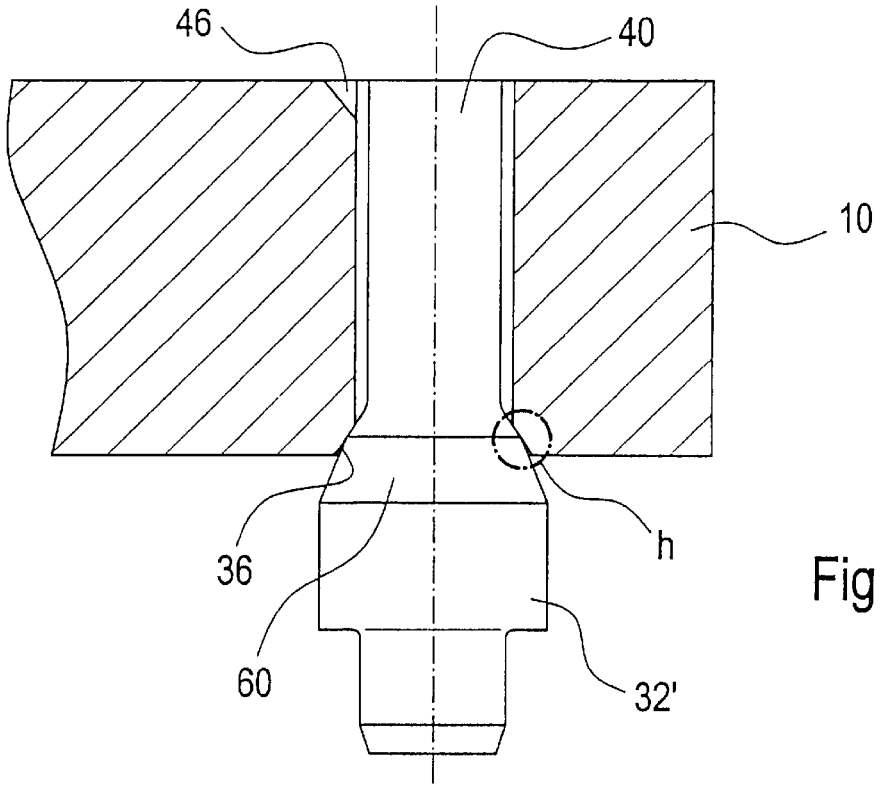
FIG. 7*g*, on an enlarged scale, schematically shows a detail of a further variant of the control valve shown in FIG. 7*b;*
Figure 7H:
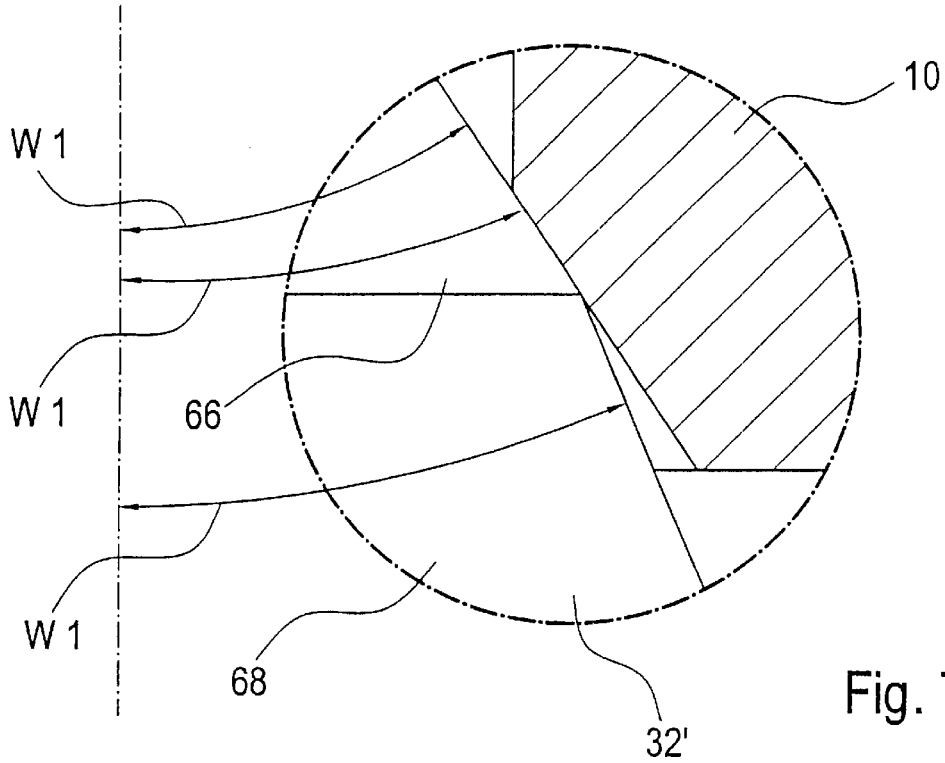
FIG. 7*h* shows the detail marked "h" in FIG. 7*g*, enlarged still further.

In FIGS. 7*g* and 7*h*, still another variant of the control valve shown in FIG. 7b is shown. Here, the valve cone 32' has no extension, so that there is no dual guidance for the valve cone. Similarly to the previous variant, the valve face 60 of the valve cone 32' comprises two frustoconical faces 66, 68. The opening angle W1 of the valve seat formed with the center axis is 29.5° here, while the angles W2 and W3 of the frustoconical faces 66, 68 of the valve face 60 are 30.5° and 22.5°, respectively.

Because of the acute angle that the face of the valve seat forms with the center axis, radial expulsion of the valve cone from its valve seat, which could be caused by a laterally-acting pressure wave from the diversion bore or by a radial component of the force of the valve spring, is reliably avoided. This makes the second, double piston guidance, which is complicated from a production standpoint, unnecessary, while the production effort and cost for the valve seat remain the same. The acute-angle double-cone valve face contributes to secure sealing.

Figure 8B:
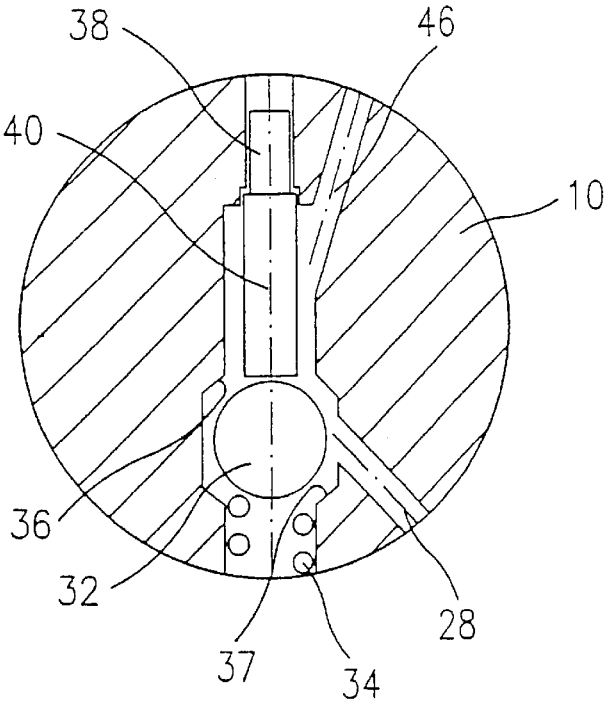
FIG. 8*b*, on an enlarged scale, schematically shows the control valve used in the injection nozzle of FIG. 8*a*.
Figure 8A:
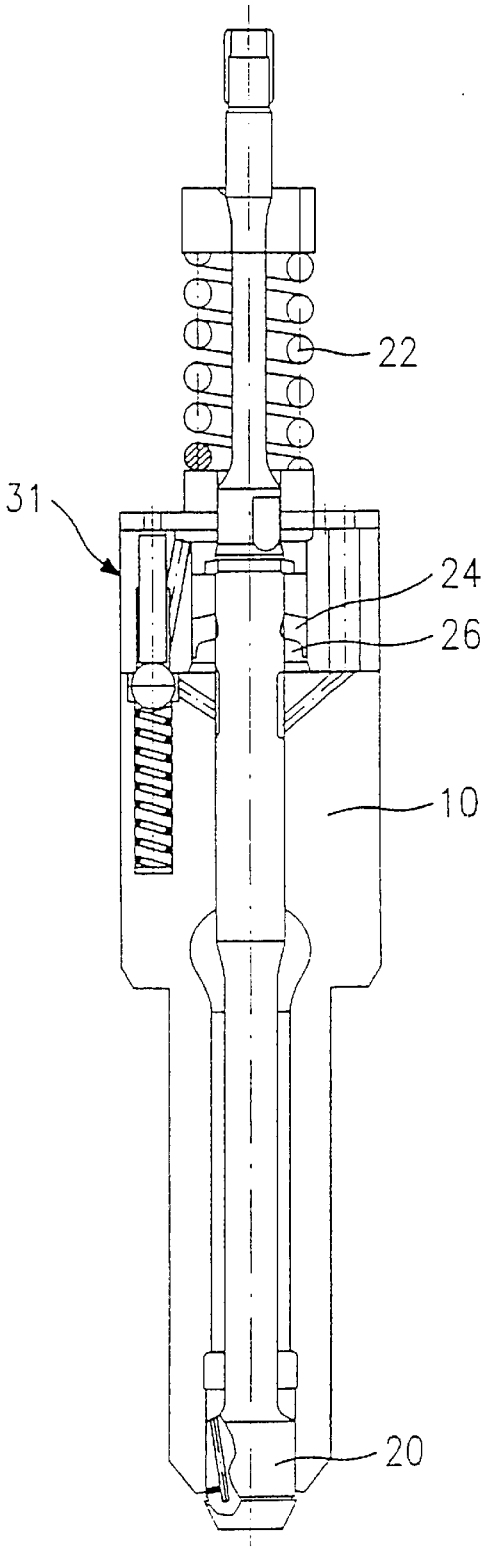
FIG. 8*a* shows an injection nozzle in a second variant of the second embodiment.

In FIGS. 8*a* and 8*b*, a second variant of the second embodiment is shown. Where components are used in this variant that are known from the preceding figures, the same reference numerals are used, and reference is made to the above descriptions.

Unlike the first variant, here again, as already known from FIG. 3, a valve ball 32 is used, which can be lifted from the first valve seat 36 by the control piston 38 via the extension 40 and pressed against the second valve seat 37.

In this variant as well, upon a pressure buildup in the control valve, a self-holding function is obtained, since the face of the valve ball remote from the control piston 38 is not acted upon by the higher pressure.

One advantage over the first variant is that the valve ball 32, which is movable relative to the extension 40, enables an automatic balancing of tolerances between the guidance for the control piston and the valve seats.

The foregoing relates to preferred exemplary embodiments of the invention, it being understood that other variants and embodiments thereof are possible within the spirit and scope of the invention, the latter being defined by the appended claims.

We claim:

1. An injection nozzle, comprising a nozzle body (10), a nozzle needle (20) displaceable in the nozzle body (10), two groups of injection ports (12, 14), which are uncovered as a function of an opening stroke of the nozzle needle (20), a piston (24) that is connected to the nozzle needle (20), a stop chamber (26) in which the piston is disposed, the piston (24) defining an upper portion and a lower portion of the stop chamber (26), one of the portions being provided with an outlet (28), and a control valve (31) operable to open and close the outlet (28) of the stop chamber (26), as a result of which the stroke of the piston (24) in the stop chamber (26) and thus the opening stroke of the nozzle needle (20) can be selectively limited.

2. The injection nozzle of claim 1, wherein the control valve is a magnet valve.

3. The injection nozzle of claim 2, wherein the control valve (31) comprises a valve element (32), which is urged by a valve spring (34) against a valve seat (36) and can be lifted from the valve seat (36) by an actuating part (38, 40; 39, 40).

4. The injection nozzle of claim 3, wherein the valve element is a valve ball (32).

5. The injection nozzle of claim 1, wherein the control valve (31) comprises a valve element (32), which is urged by a valve spring (34) against a valve seat (36) and can be lifted from the valve seat (36) by an actuating part (38, 40; 39, 40).

6. The injection nozzle of claim 5, wherein the valve element is a valve ball (32).

7. The injection nozzle of claim 5, wherein the valve element is a valve cone (32').

8. The injection nozzle of claim 7, wherein the valve cone (32') has a valve face (60) which is embodied as a spherical portion.

9. The injection nozzle of claim 7, wherein the valve cone has a valve face (60) which is embodied by two frustoconical faces (66, 68) adjacent to one another.

10. The injection nozzle of claim 9, wherein opening angle W2 of the frustoconical face (66) that located closer to the extension (40) is slightly smaller than opening angle W1 of the valve seat (36).

11. The injection nozzle of claim 10, wherein the angle W1 is about 29.5°, and the angle W2 is about 30.5°.

12. The injection nozzle of claim 9, wherein opening angles W2 and W3 of the two frustoconical faces (66, 68) differ sharply from the opening angle W1 of the valve seat.

13. The injection nozzle of claim 12, wherein the opening angles W2 and W3 of the two frustoconical faces are about 80° and 45°, respectively, and the opening angle W1 of the valve seat is approximately 70°.

14. The injection nozzle of claim 5, wherein the actuating part is a piezoelectric actuator (39).

15. The injection nozzle of claim 5, wherein the actuating part is a control piston (38), which can be acted upon by fuel that is at a low pressure.

16. The injection nozzle of claim 15, wherein the low pressure is equal to a fuel prefeed pressure.

17. The injection nozzle of claim 15, wherein the low pressure is furnished by a separate supply system.

18. The injection nozzle of claim 15, wherein the low pressure is derived from leakage from a high-pressure fuel system.

19. The injection nozzle of claim 5, further comprising a second valve seat (37), on which the valve element (32; 32') can rest when the control valve is open.

20. The injection nozzle of claim 1, wherein the nozzle needle (20) is provided with both groups of injection ports (12, 14).

21. The injection nozzle of claim 1, wherein the nozzle body (10) is provided with both groups of injection ports (12, 14).

22. An injection nozzle, comprising a nozzle body (10), a nozzle needle (20) displaceable in the nozzle body (10), two groups of injection ports (12,14), which are uncovered as a function of an opening stroke of the nozzle needle (20), a piston (24) that is connected to the nozzle needle (20), a stop chamber (26) in which the piston is disposed and which is provided with an outlet (28), and a control valve (31) operable to open and close the outlet (28) of the stop chamber (26), as a result of which the stroke of the piston (24) in the stop chamber (26) and thus the opening stroke of the nozzle needle (20) can be selectively limited, said control valve (31) being embedded in the injection nozzle and located in proximity to the stop chamber (26).

* * * * *